US008599232B2

(12) United States Patent
Gal et al.

(10) Patent No.: US 8,599,232 B2
(45) Date of Patent: Dec. 3, 2013

(54) INTEGRAL CUSHION FOR FLEXOGRAPHIC PRINTING PLATES

(75) Inventors: Ido Gal, Kfar-saba (IL); Yehuda Solomon, Rishon Le Zion (IL); Ophira Melamed, Shoham (IL); Lior Perry, Ramat Gan (IL)

(73) Assignee: Eastman Kodak Company, Rochester, NY (US)

( * ) Notice: Subject to any disclaimer, the term of this patent is extended or adjusted under 35 U.S.C. 154(b) by 99 days.

(21) Appl. No.: 13/238,280

(22) Filed: Sep. 21, 2011

(65) Prior Publication Data

US 2013/0070038 A1 Mar. 21, 2013

(51) Int. Cl.
*B41J 2/435* (2006.01)

(52) U.S. Cl.
USPC ..... 347/224

(58) Field of Classification Search
USPC ..... 347/224, 225; 101/450.1, 453–467; 430/204, 205
See application file for complete search history.

(56) References Cited

U.S. PATENT DOCUMENTS

| | | | | |
|---|---|---|---|---|
| 3,425,347 | A | 2/1969 | Nard et al. | |
| 3,903,794 | A | 9/1975 | Grupe et al. | |
| 4,574,697 | A | 3/1986 | Feeley | |
| 5,325,776 | A | 7/1994 | Rather, Sr. et al. | |
| 5,760,880 | A * | 6/1998 | Fan et al. | 355/67 |
| 5,894,799 | A | 4/1999 | Bart et al. | |
| 6,247,403 | B1 | 6/2001 | Randazzo | |
| 6,666,138 | B2 | 12/2003 | Randazzo | |
| 7,419,766 | B2 * | 9/2008 | Kimelblat et al. | 430/302 |
| 7,785,431 | B2 | 8/2010 | Kuczynski et al. | |
| 8,034,540 | B2 * | 10/2011 | Zwadlo | 430/306 |
| 2009/0211480 | A1 | 8/2009 | Castillo et al. | |

FOREIGN PATENT DOCUMENTS

| | | | |
|---|---|---|---|
| EP | 2 246 377 | A1 | 11/2010 |
| WO | 2007/106489 | A1 | 9/2007 |

* cited by examiner

*Primary Examiner* — Hai C Pham
(74) *Attorney, Agent, or Firm* — Nelson Adrian Blish

(57) ABSTRACT

A system for preparing a flexographic printing plate having a printing layer, a second layer, and a cushion layer includes a first laser for imaging a first zone on a bottom surface of the cushion layer; and wherein the first laser or a second laser images a first area of a top surface of the printing layer which corresponds to the first zone.

12 Claims, 2 Drawing Sheets

INTEGRAL CUSHION FOR FLEXOGRAPHIC PRINTING PLATES

CROSS REFERENCE TO RELATED APPLICATIONS

Reference is made to commonly-assigned copending U.S. patent application Ser. No. 13/238,261, filed Sep. 21, 2011, entitled INTEGRAL CUSHION FOR FLEXOGRAPHIC PRINTING PLATES, by Gal et al.; the disclosure of which is incorporated herein.

FIELD OF THE INVENTION

This invention relates to compositions and method of preparation of flexographic printing members with specially contoured cushions for use during printing as a means of compensating for variations of pressure over the surface of the printing member during the printing process.

BACKGROUND OF THE INVENTION

Flexographic printing is a method of direct printing similar to letterpress that uses resilient relief-image plates, sleeves or cylinders of rubber or photopolymer material.

Historically the plate preparation has progressed from hand carving to imagewise photopolymerization to laser engraving. Whichever method of printing member preparation is used the finished product suffers from reduced print quality due to highly localized pressure during the printing operation. U.S. Pat. No. 3,425,347 (Nard et al.) suggests that the effect is caused for instance by "inaccuracies inherent in a rubber plate", or the center of a printing area being pulled down during formation (the defect being known then as "cupping"). As a remedy, the inventors suggest the use of a patterned cushion attached to the underside of the print surface.

U.S. Pat. No. 3,903,794 (Grupe et al.) describes a resilient foam which is cast onto a support, ground down to give uniform thickness cushion, and then attached to the printing member.

U.S. Pat. No. 4,574,697 (Feely) describes a foam mounted on a base film where the film and the foam are both coated with adhesive. The base film is bonded to the printing press cylinder and the foam is bonded to the back side of the imaged flexographic printing member. The invention is not so much concerned with the cushioning effect of the foam as with the retention of integrity of the foam/base on removal from the print cylinder after printing.

U.S. Pat. No. 5,325,776 (Rather Sr. et al.) claims improved cushioning relative to previous cushions that had suffered from lack of deformability or if they were readily deformable, from a lack of sufficient resiliency to rebound rapidly enough and repeatedly to the original dimensions. Also, most materials were not sufficiently accurate in caliper to give uniform print quality. The cushioning material disclosed contained closed cells and elastomeric particles dispersed in, for instance, a polyurethane rubber.

U.S. Pat. No. 5,894,799 (Bart et al.) claims that the closed cells of a cushion tend to break on successive use such that the cushioning material shows fatigue, loses compression and resilience qualities and thus the print quality deteriorates. Bart et al. describes an open cell structure for the cushion with a minimum total void of 40 percent. Bart et al. discloses the application of cushions to flexographic printing members imaged by laser engraving.

U.S. Pat. Nos. 6,247,403 and 6,666,138 (both to Randazzo) suggests a different type of cushion. Instead of the foam structure of the cushions described in earlier patents, Randazzo uses patterns of protrusions. U.S. Publication No. 2009/0211480 (Castillo et al.) describes cushions with low friction surfaces to improve printing.

Recent developments in plate imaging have resulted in significant improvements in print quality and higher expectation from customers who for instance wish to use flexographic printing for high quality packaging applications. As described in the above publications, it has now become the general practice to attach the imaged flexographic printing member to a cushion. Pressure on the surface image of the flexographic printing member during printing, instead of causing image distortion, is taken up by slight compression of the cushion. This cushion may be selected from a range of cushions designed to fit the requirements of the imaged flexographic plate.

Tapes are manually bonded to the back surface of the imaged flexographic plate. This procedure has to be done carefully to avoid air pockets. A variety of tapes are sold to suit different plates and different types of images. Where one plate contains different types of image, either the image may be split up into text and pictures and extra sets of plates made to accommodate the split up images or a combination of tapes may be used to optimize print quality. When a print customer wants solid ink and crisp lines, the printer needs firm, high-density tape. When a printer needs to consistently balance solid and dot reproduction on the same plate, a wide range of combination printing tapes can be considered."

Thus, different parts of the same flexographic printing member may benefit from different cushions. This can be done by cutting and sticking different types of tape corresponding to different areas of the plate, requiring additional manual manipulations. This type of problem was addressed by in U.S. Pat. No. 7,785,431 (Kuczynski et al.) by the incorporation of monomers into the plate precursor that could be used to selectively harden the plate in zones after imaging.

Another problem is that cushion thickness tolerance is much wider than that of the flexographic plate itself and that this introduces further challenges of unevenness.

SUMMARY OF THE INVENTION

Briefly, according to one aspect of the present invention a system for preparing a flexographic printing plate having a printing layer, a second layer, and a cushion layer includes a first laser for imaging a first zone on a bottom surface of the cushion layer; and wherein the first laser or a second laser images a first area of a top surface of the printing layer which corresponds to the first zone.

This invention addresses both of the above problems especially with respect to direct laser engraving. An ablatable cushion layer is provided on the back of the printing member precursor or a previously imaged printing member. Either before or after imaging the front of the printing member, the digital information stored for printing member imaging is used whilst patterning the back of the printing member. Patterning is such that the back of the printing member assumes cushioning properties and that these properties vary to correspond to the types of imaging areas on the opposite side of the printing member.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
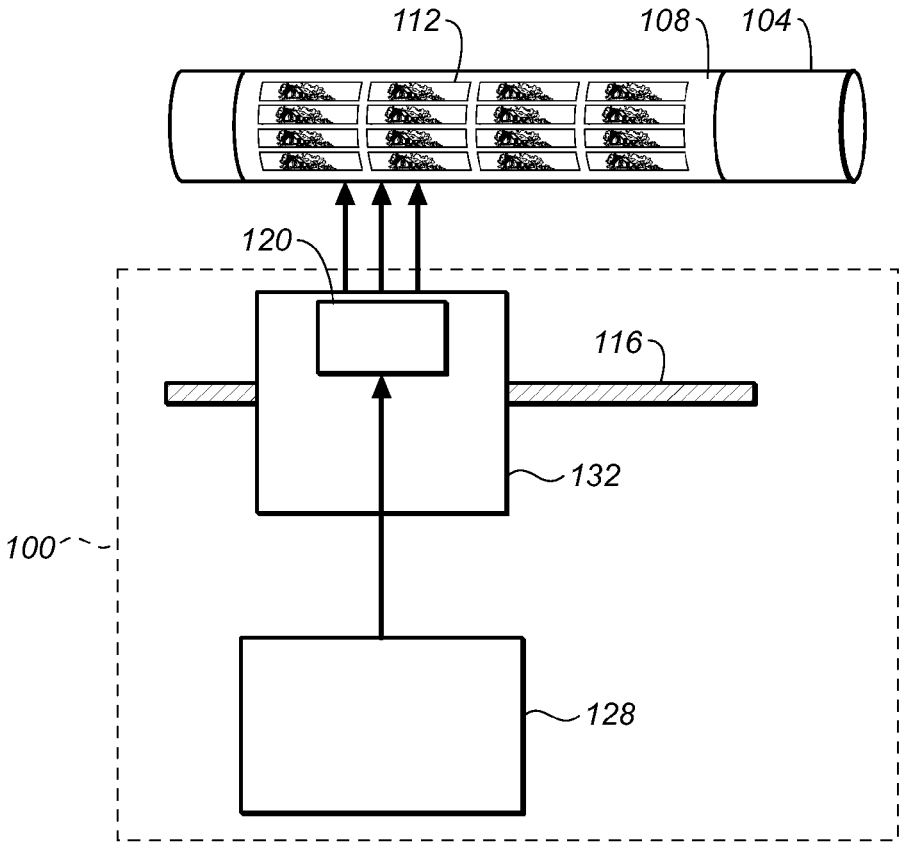
FIG. 1 (PRIOR ART)
FIG. 1 is a prior art diagrammatic form an imaging head for a drum based imaging device.

FIG. 1 shows an imaging system 100. The imaging system 100 includes an imaging carriage 132 on which an imaging head 120 is mounted. The imaging head 120 is controlled by controller 128. The imaging head 120 is configured to image on a printing plate 108 mounted on a rotating cylinder 104. The carriage 132 is adapted to move substantially in parallel to rotating cylinder 104 guided by an advancement screw 116. The printing plate 108 is imaged by imaging head 120 to form an imaged data 112 on plate 108.

Figure 2:
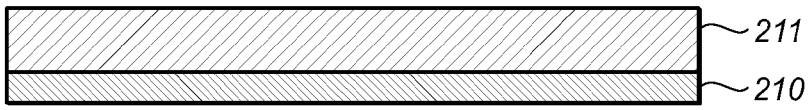
FIG. 2 (PRIOR ART)
FIG. 2 is a diagrammatic representation of a cross-sectional view of a simple laser-engraveable flexographic printing member precursor.

Preferred embodiments of the process using an imaging system such as system 100 are described using FIGS. 2 to 5. FIG. 2 is a diagrammatic representation of a cross-sectional view of a simple flexographic printing member precursor. It is preferable but not essential that such a precursor is laser engraveable although it is contemplated that it can be imaged by any other means known to the art. It can have one or more elastomeric layers, represented in the diagram as layer 211. Such a layer must be capable of being used to generate a relief image corresponding to information supplied to it in the form of digital or analogue information. The plate precursor is mounted on one or more dimensionally stable layers designated 210 in the figure.

Figure 3:
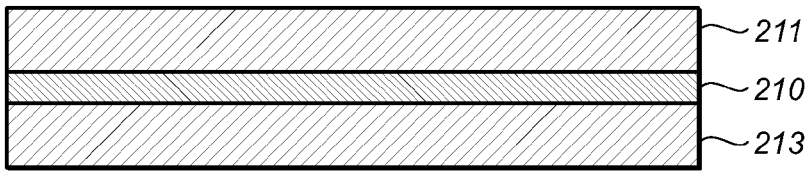
FIG. 3 is a diagrammatic representation of a cross-sectional view of a laser-engraveable flexographic printing member precursor with a back-coat which may be laser engraved to give a integral contoured cushion.

FIG. 3 is a diagrammatic representation of a cross sectional view of a laser engraveable flexographic plate precursor of one of the embodiments of the invention where the precursor shown in FIG. 2 has an integral cushion precursor labeled 213. The cushion layer 213 may comprise one or more elastomeric layers. The material used for the ablatable cushion may comprise the same as or different materials as the upper layer 211. The cushion layer 213 may for instance be a rubber such as EPDM, or polyurethane. It may itself be of a foam nature and be formulated to be ablated significantly faster than the imaging process used to produce the relief on the front surface of the laser engraveable layer 211.

Thus, it has been found possible to engrave this type of cushion from a precursor at a far greater speed than is possible for the printing image and this is highly desirable. The reason for this is that the back cushion has less constraining parameters than the printing layer. For instance, the cushion layer can contain larger particles which if used in the printing layer would spoil the image quality. Thus, it is possible to load the cushion with a polymeric filled microsphere such as Expancel. The material also does not need to have high solvent resistance because unlike the front surface it does not come into direct contact with the solvents of the flexographic ink.

Figure 4:
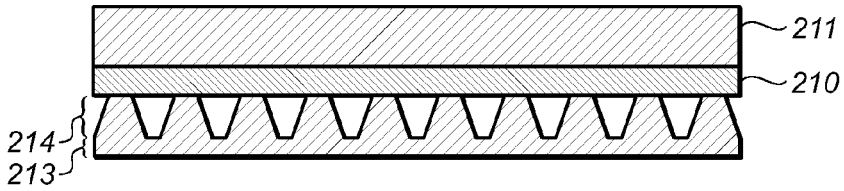
FIG. 4 is a diagrammatic representation of a cross-sectional view of the laser-engraveable flexographic printing member precursor of FIG. 3, wherein the back surface has been laser engraved to correspond to the image pattern that will be subsequently engraved on the printing surface.

FIG. 4 shows the printing member precursor of FIG. 3 with an engraved contoured cushion image 214. The engraved contoured cushion image will correspond to the printable image in that the ablated areas will sit directly underneath the non ablated areas of the printed image. The efficacy of this approach is indicated by a simple experiment. Measurement of the durometer hardness of a plate precursor with and without a cushion which has a 10% tint image engraved on it to imitate a contoured cushion shows that a plate precursor without the cushion gave a shore hardness of 73 and with the cushion this was reduced to 67.

Figure 5:
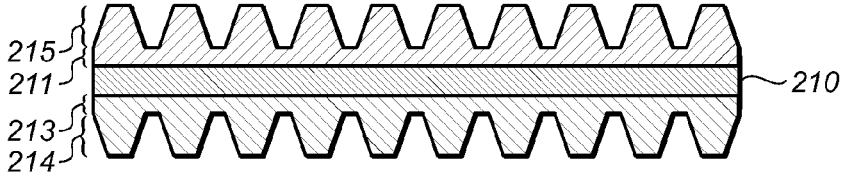
FIG. 5 is a diagrammatic representation of a cross-sectional view of the laser-engraveable flexographic printing member precursor of FIG. 4 with the printable relief image engraved on the printing surface.

FIG. 5 shows the flexo printing plate with the front side imaged (211/215) and the contoured cushion (213/214) of FIG. 4. The plate is ready for mounting on the flexographic printing press.

Thus, to summarize the process of imaging the printing member precursor received by the customer or trade house, the cushion and the printing layer, the following stages are needed. Image the back surface of the plate by laser ablation to produce the contoured cushion. Image the front printing surface of the plate preferably by laser ablation.

If the back pattern is a direct reflection of the front image, it provides a right reading type of image that can more easily be used for proof reading than the laterally inverted front image. The difference is that the background of the image corresponds to the raised areas of the cushion and the printing surface corresponds to the floor areas. Thus it is necessary to utilize the digital information used to produce the front printing image to produce a corresponding back image that constitutes the cushion. The overall plate thickness can be controlled to the tolerance of plates as required and the cushioning will not harm this.

The time taken to suitably ablate the backside of the plate is more than compensated by the time saved to mount tape cushions and the increase in print quality that can be obtained.

Figure 6:
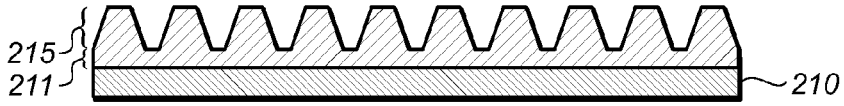
FIG. 6 is a laser engraved cushion sheet on a support.
Figure 7:
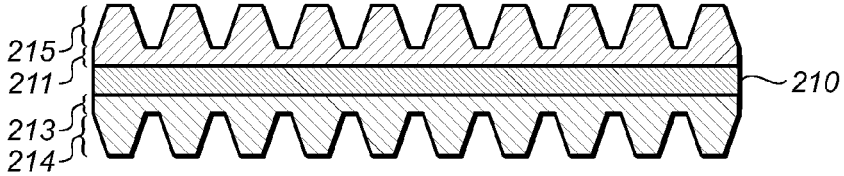
FIG. 7 is the laser engraved cushion sheet of FIG. 6 under a laser engraved flexographic printing member precursor where the engraved surface of the contoured cushion is uppermost.
Figure 8:
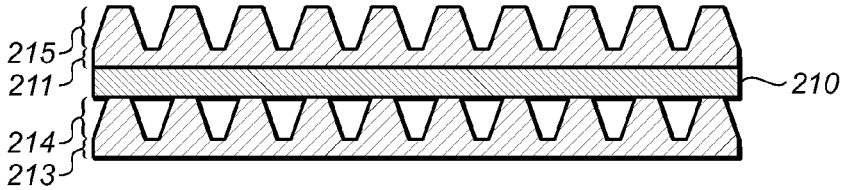
FIG. 8 is the laser engraved cushion sheet of FIG. 6 under a laser engraved flexographic printing member precursor where the engraved surface of the contoured cushion is positioned downwards.

An alternative embodiment is described by FIGS. 6 to 8. FIG. 6 is a simple imaged flexographic printing member which has been imaged. The elastomeric layer is labeled 211, the dimensionally stable layer is 210 and the image is 215.

FIG. 7 shows a separate imaged cushion 213/214 which is bonded face down onto the back of the imaged plate of FIG. 6. The cushion may or may not have a thin dimensionally stable support. The plate and the cushion should be aligned by some means. This can be accomplished by alignment by exact positioning on the imager.

FIG. 8 represents an alternative plate and cushion configuration where the cushion is bonded with its image side uppermost.

The invention has been described in detail with particular reference to certain preferred embodiments thereof, but it will be understood that variations and modifications can be effected within the scope of the invention.

PARTS LIST

100 imaging system
104 rotating cylinder

108 printing plate
112 imaged data
116 screw
120 imaging head
128 controller
132 carriage
210 stable support layer
211 laser engraveable layer
213 cushion layer
214 contoured image on cushion layer
215 image on engraveable layer

The invention claimed is:

1. A system for preparing a flexographic printing plate having a printing layer, a second layer, and a cushion layer comprising:

a first laser for imaging a first zone on a bottom surface of the cushion layer; and wherein the first laser or a second laser images a first area of a top surface of the printing layer which corresponds to the first zone.

2. The system of claim 1 wherein:

the first laser images a second zone on the bottom surface of the cushion layer and a second area of the top surface of the printing layer which corresponds to the second zone.

3. The system of claim 2 wherein the first area comprises a solid printing area and the second area comprises a text printing area.

4. The system of claim 2 wherein imaging the bottom surface softens the cushion layer in the first zone and the second zone and the softness of the first and second zone is different.

5. The system of claim 1 wherein imaging the bottom surface softens the cushion layer in the first zone.

6. The system of claim 1 wherein the cushion layer is less sensitive to radiation than the printing layer.

7. The system of claim 1 wherein cushion layer is more sensitive than the printing layer.

8. The system of claim 1 wherein the cushion layer and the printing layer are selected from a group consisting of rubbers such as EPDM, Natural, Neoprene, silicon, fluorocarbon, SBR, NBR or Butyl rubber.

9. The system of claim 1 wherein the second layer is a polyethylene terephthalate support.

10. The system of claim 1 wherein the second layer has a higher hardness then both the printing layer and cushion layer.

11. The system of claim 1 wherein imaging is by laser ablation.

12. An system for preparing a flexographic printing plate having a printing layer, a second layer, and a cushion layer comprising:

a drum for mounting the flexographic printing plate wherein the flexographic printing plate is mounted with the printing layer adjacent to a surface of the drum;

a light source for imaging a first zone on a bottom surface of the cushion layer;

removing the flexographic printing plate from the drum;

mounting the flexographic printing plate with the cushion layer adjacent the surface of the drum; and imaging a first area of a top surface of the printing layer which corresponds to the first zone with the laser.

* * * * *